US006615137B2

(12) United States Patent
Lutter et al.

(10) Patent No.: US 6,615,137 B2
(45) Date of Patent: Sep. 2, 2003

(54) METHOD AND APPARATUS FOR TRANSFERRING INFORMATION BETWEEN VEHICLES

(75) Inventors: Robert Pierce Lutter, Tacoma, WA (US); Dan Alan Preston, Bainbridge Island, WA (US)

(73) Assignee: Medius, Inc., Seattle, WA (US)

( * ) Notice: Subject to any disclaimer, the term of this patent is extended or adjusted under 35 U.S.C. 154(b) by 0 days.

(21) Appl. No.: 09/892,333

(22) Filed: Jun. 26, 2001

(65) Prior Publication Data

US 2002/0198660 A1 Dec. 26, 2002

(51) Int. Cl.[7] ..... G08G 1/16

(52) U.S. Cl. ..... 701/301; 701/45; 701/117; 340/436

(58) Field of Search ..... 701/45, 301, 117; 340/436, 902, 903; 180/167, 169; 342/70, 71, 72

(56) References Cited

U.S. PATENT DOCUMENTS

| | | | | | |
|---|---|---|---|---|---|
| 5,471,214 | A | * | 11/1995 | Faibish et al. | 342/54 |
| 5,646,612 | A | * | 7/1997 | Byon | 340/436 |
| 5,907,293 | A | * | 5/1999 | Tognazzini | 340/436 |
| 5,969,598 | A | * | 10/1999 | Kimura | 180/274 |
| 5,983,161 | A | * | 11/1999 | Lemelson et al. | 340/436 |
| 6,243,450 | B1 | | 6/2001 | Jansen et al. | |
| 6,292,109 | B1 | * | 9/2001 | Murano et al. | 340/902 |
| 6,326,903 | B1 | * | 12/2001 | Gross et al. | 340/902 |
| 6,327,536 | B1 | * | 12/2001 | Tsuji et al. | 340/435 |
| 6,405,132 | B1 | * | 6/2002 | Breed et al. | 701/117 |
| 6,429,789 | B1 | * | 8/2002 | Kiridena et al. | 340/905 |

FOREIGN PATENT DOCUMENTS

| | | | |
|---|---|---|---|
| DE | 3125161 A | * | 1/1983 |
| EP | 0441576 A2 | * | 8/1991 |
| JP | 02000207691 A | * | 7/2000 |
| WO | WO96/24229 | | 8/1996 |
| WO | WO99/08436 | | 2/1999 |
| WO | WO99/57662 | | 11/1999 |
| WO | WO99/65183 | | 12/1999 |
| WO | WO01/30061 | | 4/2001 |
| WO | WO01/58110 | | 8/2001 |

OTHER PUBLICATIONS

Product description of Raytheon RT Secure, "Embedded Hard Real–Time Secure Operating System", Copyright 2000, pp. 1–2.

Product description of Raytheon RT Secure, Copyright 2001, pp. 1–2.

Product description of Raytheon RT Secure, "Development Environment", Copyright 2001, pp. 1–2.

Product description of Raytheon Electronic Systems (ES), Copyright 2002, pp. 1–2.

H. Chung, L. Ojeda, and J. Borenstein, "Sensor Fusion for Mobile Robot Dead–reckoning with a Precision–calibrated Fiber Optic Gyroscope", 2001 IEEE International Conference on Robotics and Automation, Seoul, Korea, May 21–26, pp. 1–6.

A. Das, R. Fierro, V. Kumar, J. Ostrowski, J. Spletzer, and C. Taylor, "A Framework for Vision Based Formation Control", IEEE Transactions on Robotics and Automation, vol. XX, No. Y, 2001, pp. 1–13.

(List continued on next page.)

*Primary Examiner*—Michael J. Zanelli
(74) *Attorney, Agent, or Firm*—Marger Johnson & McCollom, PC

(57) ABSTRACT

Sensor data is generated for areas around a vehicle. Any objects detected in the sensor data are identified and a kinematic state for the object determined. The kinematic states for the detected objects are compared with the kinematic state of the vehicle. If it is likely that a collision will occur between the detected objects and the local vehicle, a warning is automatically generated to notify the vehicle operator of the impending collision. The sensor data and kinematic state of the vehicle can be transmitted to other vehicles so that the other vehicles are also notified of possible collision conditions.

29 Claims, 14 Drawing Sheets

OTHER PUBLICATIONS

J. Takezaki, N. Ueki, T. Minowa, H. Kondoh, "Support System for Safe Driving—A Step Toward ITS Autonomous Driving—", Hitachi Review, vol. 49, No. 3, 2000, pp. 1–8.

S.G. Goodridge, "Multimedia Sensor Fusion for Intelligent Camera Control and Human–Computer Interaction", Dissertation submitted to the Graduate Faculty of North Carolina State University in partial fulfillment of the requirements for the degree of Doctor of Philosophy in Electrical Engineering, Raleight, NC, 1997, pp. 1–5.

M. Chantler, G. Russel, and R. Dunbar, "Probabilistic Sensor Fusion for Reliable Workspace Sensing", pp. 1–14, No date.

ISIS Project: Sensor Fusion, Linkoping University Division of Automatic Control and Communication Systems in cooperation with SAAB (Dynamics and Aircraft), 18 pages, No date.

Hirachi Automated Highway System (AHS), Automotive Products, Hitachi, Ltd., Copyright 1994–2002, 8 pages.

Vehicle Dynamics Lab, University of California, Berkeley, funded by BMW, current members: D. Caveney and B. Feldman, "Adaptive Cruise Control", 17 pages, No date.

Counterair: The Cutting Edge, Ch. 2 "The Evolutionary Trajectory The Fighter Pilot–Here to Stay?" AF2025 v3c8–2, Dec. 1996, pp. 1–7.

Counterair: The Cutting Edge, Ch. 4 "The Virtual Trajectory Air Superiority without an "Air" Force?" AF2025 v3c8–4, Dec. 1996, pp. 1–12.

TNO FEL Annual Review 1998: Quality works, 16 pages.

Boeing News Release, "Boeing Demonstrates JSF Avionics Multi–Sensor Fusion", Seattle, WA, May 9, 2000, pp. 1–2.

Boeing Statement, "Chairman and CEO Phil Condit on the JSF Decision", Washington, D.C., Oct. 26, 2001, pp. 1–2.

Ada 95 Transition Support—Lessons Learned, Sections 3, 4, and 5, CACI, Inc.—Federal, Nov. 15, 1996, 14 pages.

Joint Strike Fighter Terrain Database, ets–news.com "Simulator Solutions" 2002, 3 pages.

MSRC Redacted Proposal, 3.0 Architecture Development, pp. 1–43.

Powerpoint Presentation by Robert Allen—Boeing Phantom Works entitled "Real–Time Embedded Avionics System Security and COTS Operating Systems", Open Group Real–Time Forum, Jul. 18, 2001, 16 pages.

Green Hills Software, Inc., "The AdaMULTI 2000 Integrated Development Environment", Copyright 2002, 7 pages.

Luttge, Karsten; "E–Charging API: Outsource Charging to a Payment Service Provider"; IEEE; 2001 (pp. 216–222).

* cited by examiner

METHOD AND APPARATUS FOR TRANSFERRING INFORMATION BETWEEN VEHICLES

BACKGROUND

Vehicle collisions are often caused when a driver can not see or is unaware of an oncoming object. For example, a tree may obstruct a drivers view of oncoming traffic at an intersection. The driver has to enter the intersection with no knowledge whether another vehicle may be entering the same intersection. After entering the intersection, it is often too late for the driver to avoid an oncoming car that has failed to properly yield.

There are other situations where a vehicle is at risk of a collision. For example, a pileup may occur on a busy freeway. A vehicle traveling at 60 miles per hour, or faster, may come upon the pileup with only have a few seconds to react. These few seconds are often too short an amount of time to avoid crashing into the other vehicles. Because the driver is suddenly forced to slam on the brakes, other vehicles in back of the driver's vehicle may possibly crash into the rear end of the driver's vehicle.

It is sometimes difficult to see curves in roads. For example, at night or in rainy, snowy or foggy weather it can be difficult to see when a road curves to the left of right. The driver may then focus on the lines in the road or on the lights of a car traveling up ahead. These driving practices are dangerous, since sudden turns, or other obstructions in the road, may not be seen by the driver.

The present invention addresses this and other problems associated with the prior art.

SUMMARY OF THE INVENTION

Sensor data is generated for areas around a vehicle. Any objects detected in the sensor data are identified and a kinematic state for the object determined. The kinematic states for the detected objects are compared with the kinematic state of the vehicle. If it is likely that a collision will occur between the detected objects and the local vehicle, a warning is automatically generated to notify the vehicle operator of the impending collision. The sensor data and kinematic state of the vehicle can be transmitted to other vehicles so that the other vehicles are also notified of possible collision conditions.

DETAILED DESCRIPTION

Figure 1:
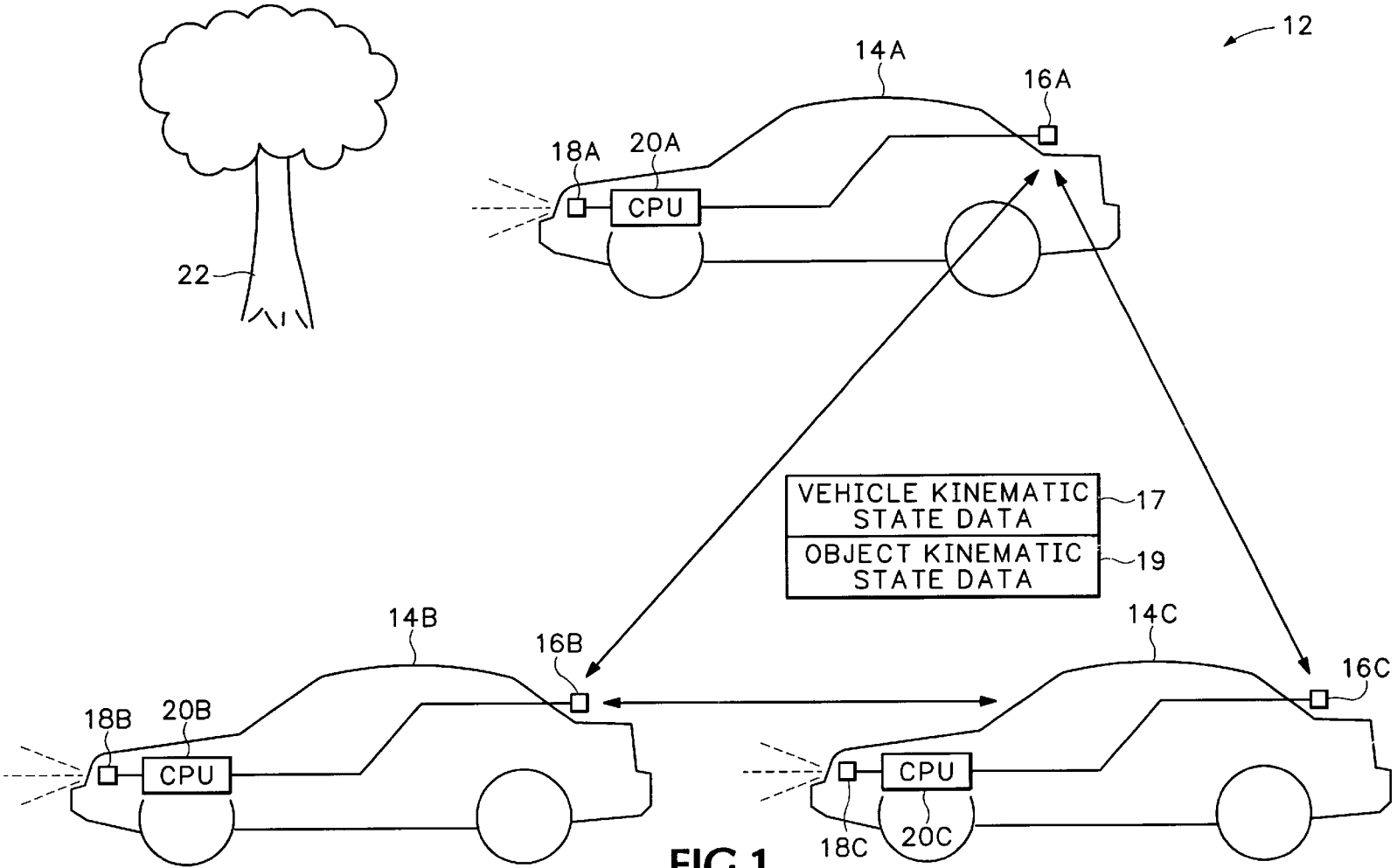
FIG. 1 is a diagram of an inter-vehicle communication system.

FIG. 1 shows a multi-vehicle communication system 12 that allows different vehicles to exchange kinematic state data. Each vehicle 14 may include one or more sensors 18 that gather sensor information around the associated vehicle 14. A transmitter/receiver (transceiver) in the vehicle 14 transmits to other vehicles kinematic state data 19 for objects detected by the sensors 18 and kinematic state data 17 for the vehicle itself. A Central Processing Unit (CPU) 20 in the vehicle 14 is coupled between the sensors 18 and transceivers 16. The CPUs 20 display the sensor information acquired from the local sensors 18 in the same vehicle and also displays, if appropriate, the kinematic state data 17 and 19 received from the other vehicles 14.

The CPU 20 for one of the vehicles, such as vehicle 14A, may identify an object 22 that is detected by the sensor 18A. The CPU 20A identifies how far the object 22 is away from the vehicle 14A. The CPU 20A may also generate a warning signal if the object 22 comes within a specific distance of the vehicle 14A. The CPU 20A then transmits the kinematic state data for object 22 to the other vehicles 14B and 14C that are within some range of vehicle 14A.

Figure 2:
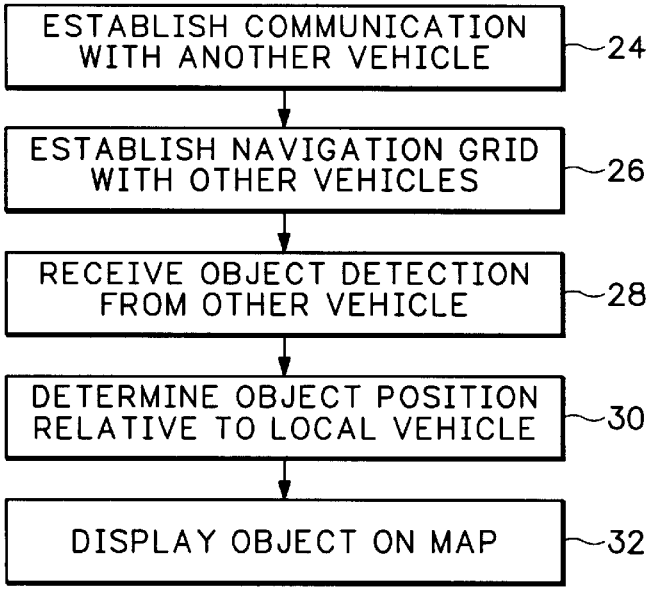
FIG. 2 is a block diagram showing how the inter-vehicle communication system of FIG. 1 operates.

Referring to FIGS. 1 and 2, the CPU 20B from vehicle 14B establishes communication with the transmitting vehicle 14A in box 24. A navigation grid is established in box 26 that determines where the vehicle 14A is in relationship to vehicle 14B. This is accomplished by the vehicle 14A sending its kinematic state data 17 such as location, speed, acceleration, and direction to vehicle 14B. The vehicle 14B receives the kinematic state data for object 22 from vehicle 14A in box 28. The CPU 20B then determines the position of object 22 relative to vehicle 14B. The CPU 20B then displays the object on a digital map in vehicle 14B in box 32. Thus, the operator of vehicle 14B can be notified of the object 22 earlier than what would be typically possible using only the local sensors 14B.

In another application, vehicle 14B receives the position of vehicle 14A and the information regarding object 22 through an intermediary vehicle 14C. The transceiver 16A in vehicle 14A transmits the kinematic state of vehicle 14A and the information regarding object 22 to vehicle 14C. The transceiver 16C in vehicle 14C then relays its own kinematic state data along with the kinematic state data of vehicle 14A and object 22 to vehicle 14B. The CPU 20B then determines from the kinematic state of vehicle 14A and the kinematic state of object 22, the position of object 22 is in relation to vehicle 14B. If the position of object 22 is within some range of vehicle 14B, the object 22 is displayed on a Graphical User Interface (GUI) inside of vehicle 14B (not shown).

Figure 3:
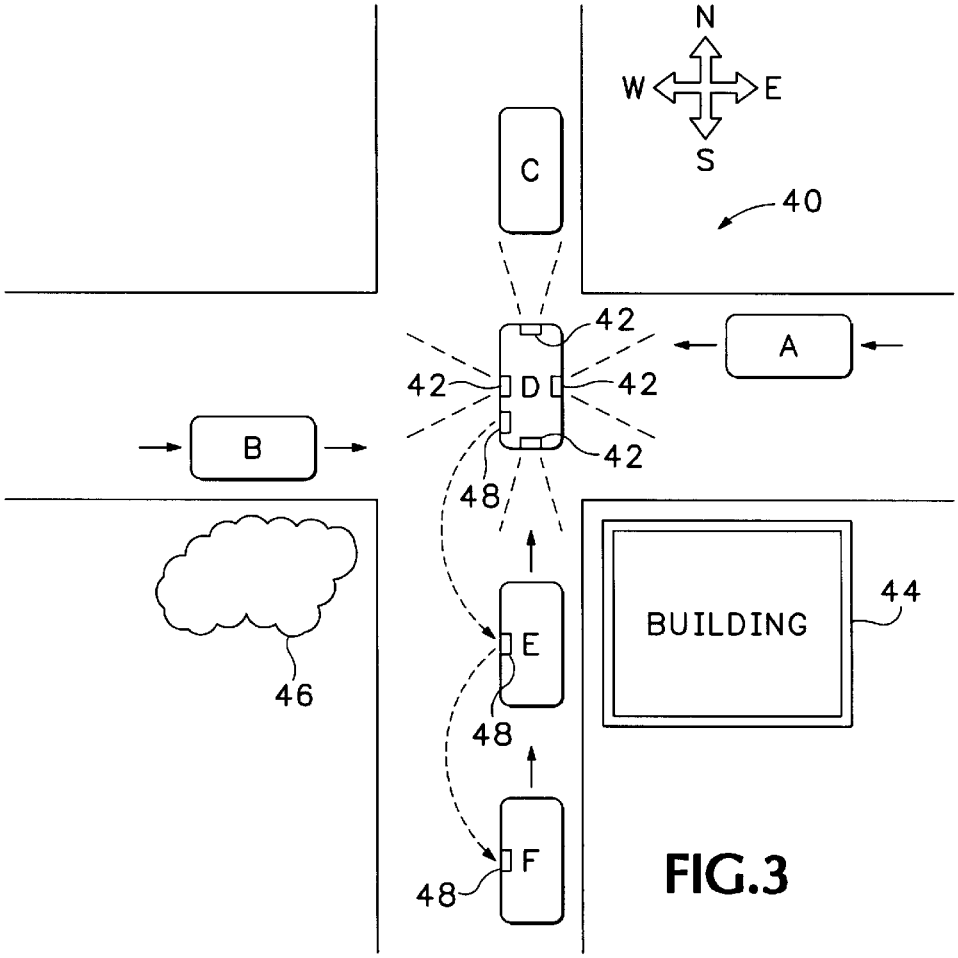
FIG. 3 is a diagram showing how sensor data can be exchanged between different vehicles.

FIG. 3 shows an example of how the Inter-vehicle communication system 12 shown in FIG. 1 can be used to identify different objects that may not be detectable from a local vehicle. There are five vehicles shown in FIG. 3. Vehicle D is in an intersection 40. A vehicle A is heading into the intersection 40 from the east and another vehicle B is heading into the intersection 40 coming from the west. Vehicle E or vehicle F may not be able to see either vehicle A or vehicle B. For example, a building 44 obstructs easterly views by vehicles E and F and a tree 46 obstructs a westerly view by vehicle E and F.

Vehicle A or vehicle B may be entering the intersection 40 at a particular speed and distance that is likely to collide with vehicle E or vehicle F. Vehicle E or vehicle F could avoid the potential collision if notified in sufficient time. However, the tree 46 and building 44 prevent vehicles E and F from seeing either vehicle A or vehicle B until they have already entered the intersection 40.

The inter-vehicle communication system warns both vehicle E and vehicle F of the oncoming vehicles B and A. Vehicle D includes multiple sensors 42 that sense objects in front, such as vehicle C, in the rear, such as vehicle E, or on the sides, such as vehicles A and B. A processor in vehicle D (not shown) processes the sensor data and identifies the speed, direction and position of vehicles A and B. A transceiver 48 in vehicle D transmits the data identifying vehicles A and B to vehicle E. A transceiver 48 in vehicle E then relays the sensor data to vehicle F.

Thus, both vehicles E and F are notified about oncoming vehicles A and B even when vehicles A and B cannot be seen visually by the operators of vehicles E and F or detected electronically by sensors on vehicle E and F. Thus the sensing ranges for vehicles E and F are extended by receiving the sensing information from vehicle D.

Figure 4:
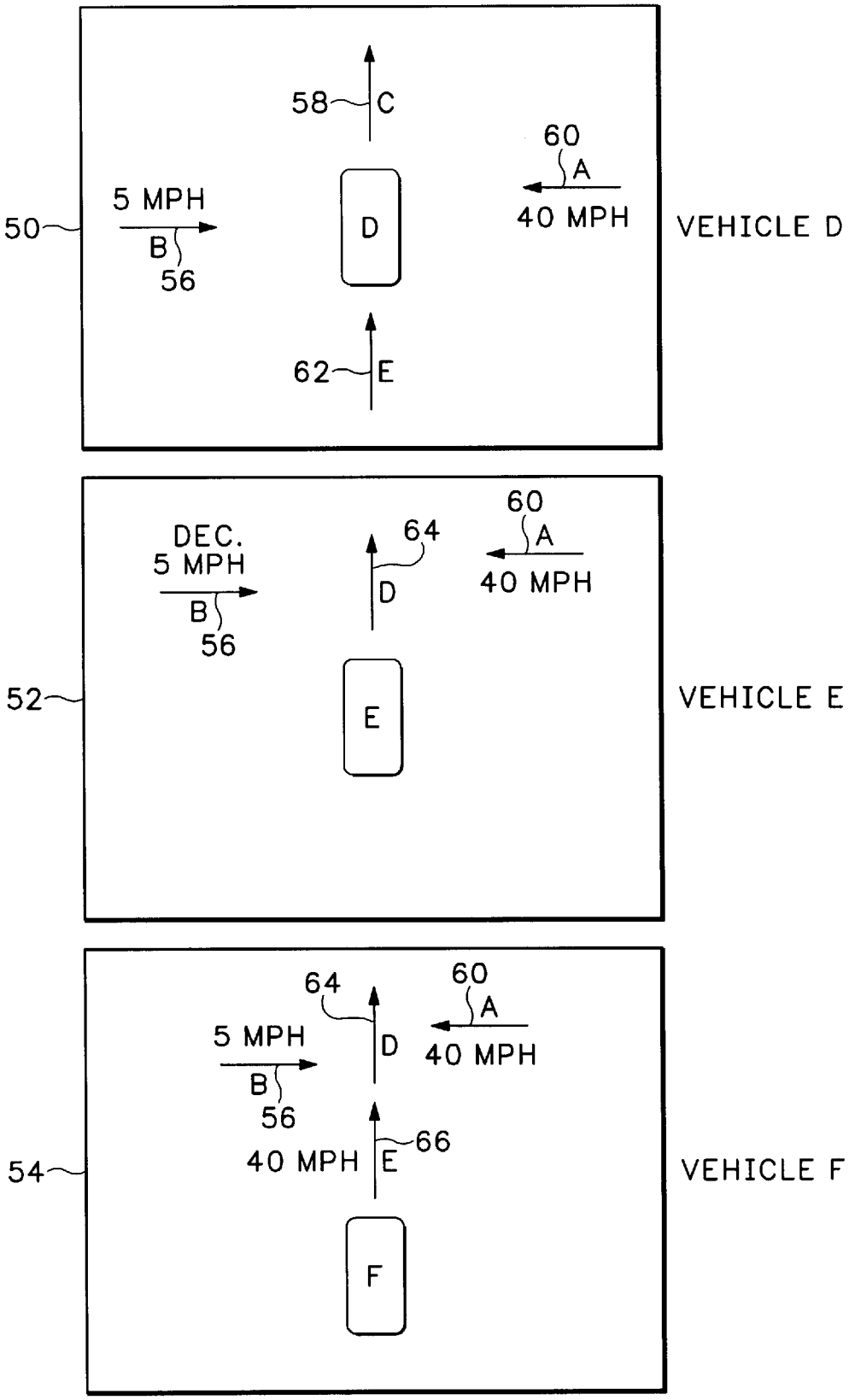
FIG. 4 is a diagram showing Graphical User Interfaces (GUIs) are used for different vehicles that share sensor data.

FIG. 4 shows three different screens 50, 52, and 54 that are displayed by vehicles D, E, and F, respectively. Each of screens 50, 52, and 54 are Graphical User Interfaces or other display systems that display sensor data and vehicle information from one or more different vehicles. Referring to screen 50, vehicle D shows different motion vectors that represent objects detected by sensors 42 (FIG. 3). A motion vector 56 shows vehicle B approaching from the west, a motion vector 58 shows vehicle C moving in front of vehicle D in a northern direction, a motion vector 60 shows vehicle A approaching from the east and a motion vector 62 shows vehicle E approaching the back of vehicle D from a southern direction.

Screen 52 shows objects displayed by the GUI in vehicle E. Motion vector 64 shows vehicle D moving in front of vehicle E and motion vectors 60 and 56 show vehicles A and B coming toward vehicle D from the east and the west, respectively. Even if the vehicles A and B can not be detected by sensors in vehicle E, the vehicles are detected by sensors in vehicle D and then transmitted to vehicle E. Screen 54 shows the motion vectors displayed to an operator of vehicle F. The motion vectors 64 and 66 shows vehicles D and E traveling north in front of vehicle F. The vehicles A and B are shown approaching vehicle D from the east and west, respectively.

The inter-vehicle communication system allows vehicles to effectively see around corners and other obstructions by sharing sensor information between different vehicles. This allows any of the vehicles to anticipate and avoid potential accidents. For example, the operator of vehicle E can see by the displayed motion vector 60 that vehicle A is traveling at 40 MPH. This provides the operator of vehicle E a warning that vehicle A may not be stopping at intersection 40 (FIG. 3). Even if vehicle E has the right of way, vehicle E can avoid a collision by slowing down or stopping while vehicle A passes through intersection 40.

In a similar manner, the motion vector 56 for vehicle B indicates deceleration and a current velocity of only 5 MPH. Deceleration may be indicated by a shorter motion vector 56 or by an alphanumeric display around the motion vector 56. The motion vector 56 indicates that vehicle B is slowing down or stopping at intersection 40. Thus, if vehicle B were the only other vehicle entering intersection 40, the operator of vehicle E is more confident about entering intersection 50 without colliding into another vehicle.

Referring to screen 54, vehicle F may not be close enough to intersection 40 to worry about colliding with vehicle A. However, screen 54 shows that vehicle E may be on a collision track with vehicle A. If vehicle E were following too close to vehicle D, then vehicle E could possibly run into the pileup that may occur between vehicle D and vehicle A. The operator of vehicle F seeing the possible collision between vehicles D and A in screen 54 can anticipate and avoid the accident by slowing down or stopping before entering the intersection 40. The operator of vehicle F may also try and prevent the collision by honk a horn.

Figure 5:
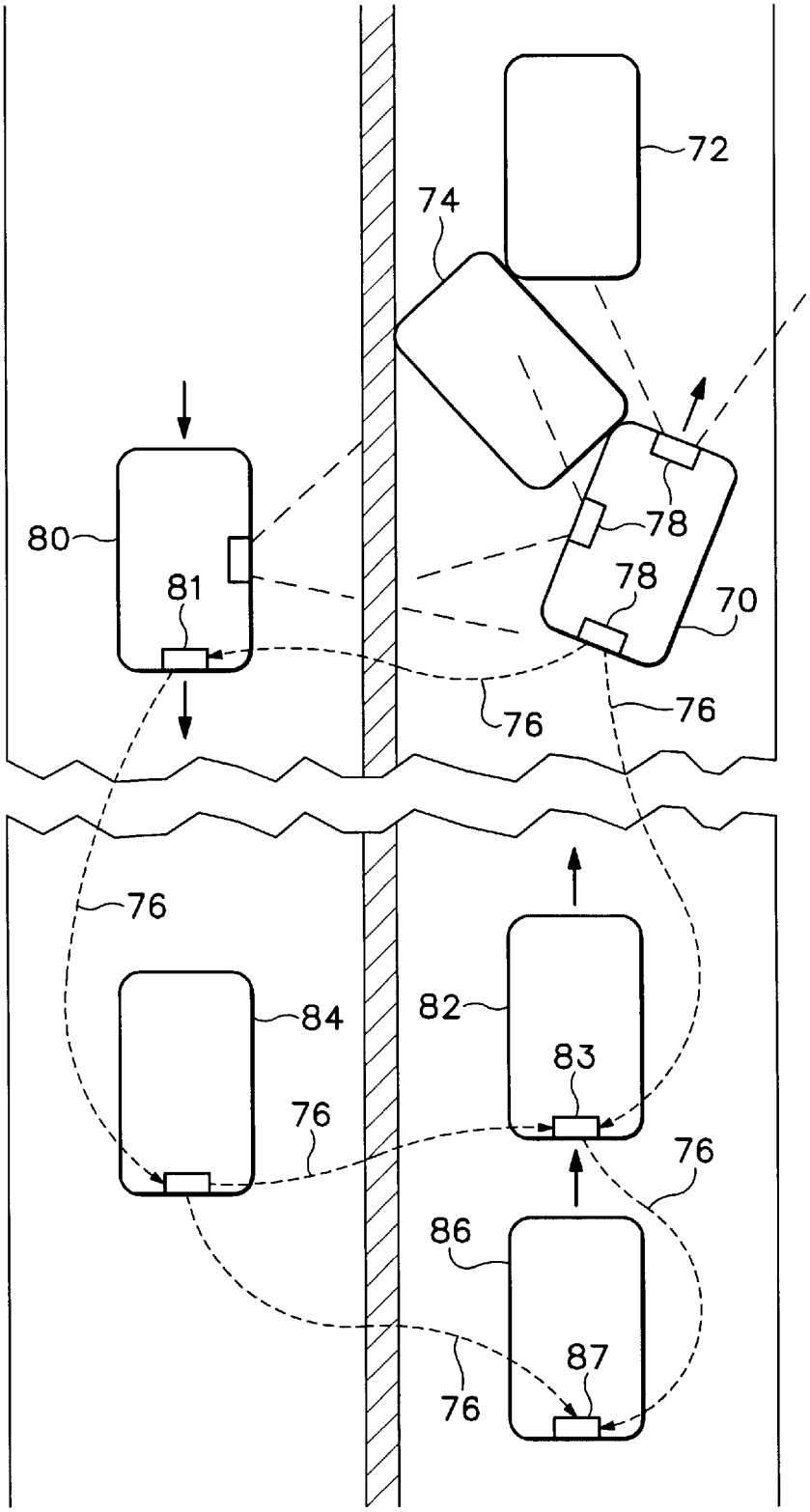
FIG. 5 is a diagram showing how collision information can be exchanged between different vehicles.

FIG. 5 shows another example of how sensor data and other vehicle kinematic state data can be transmitted between different vehicles. Vehicles 70, 72, and 74 are all involved in an accident. At least one of the vehicles, in this case vehicle 70, broadcasts a collision indication message 76. The accident indication message 76 can be triggered by anyone of multiple detected events. For example, the collision indication message 76 may be generated whenever an airbag is deployed in vehicle 70. Alternatively, sensors 78 in the vehicle 70 detect the collision. The detected collision causes a processor in vehicle 70 to broadcast the collision indication message 76.

In one example, the collision indication message 76 is received by a vehicle 80 that is traveling in the opposite traffic lane. The vehicle 80 includes a transceiver 81 that in this example relays the collision indication message 76 to another vehicle 84 that is traveling in the same direction. Vehicle 84 relays the message to other vehicles 82 and 86 that are traveling in the direction of the on coming collision.

Processors 83 and 87 in the vehicles 82 and 86, respectively, receive the collision indication message 76 and generate a warning message that may either be annunciated or displayed to drivers of vehicles 82 and 86. In another example, the collision indication message 76 is received by vehicle 82 directly from vehicle 70. The processor 83 in vehicle 82 generates a warning indication and also relays the collision indication message 76 to vehicle 86. The collision indication message 76 and other sensor data and messages can be relayed by any vehicle traveling in any direction.

Figure 6:
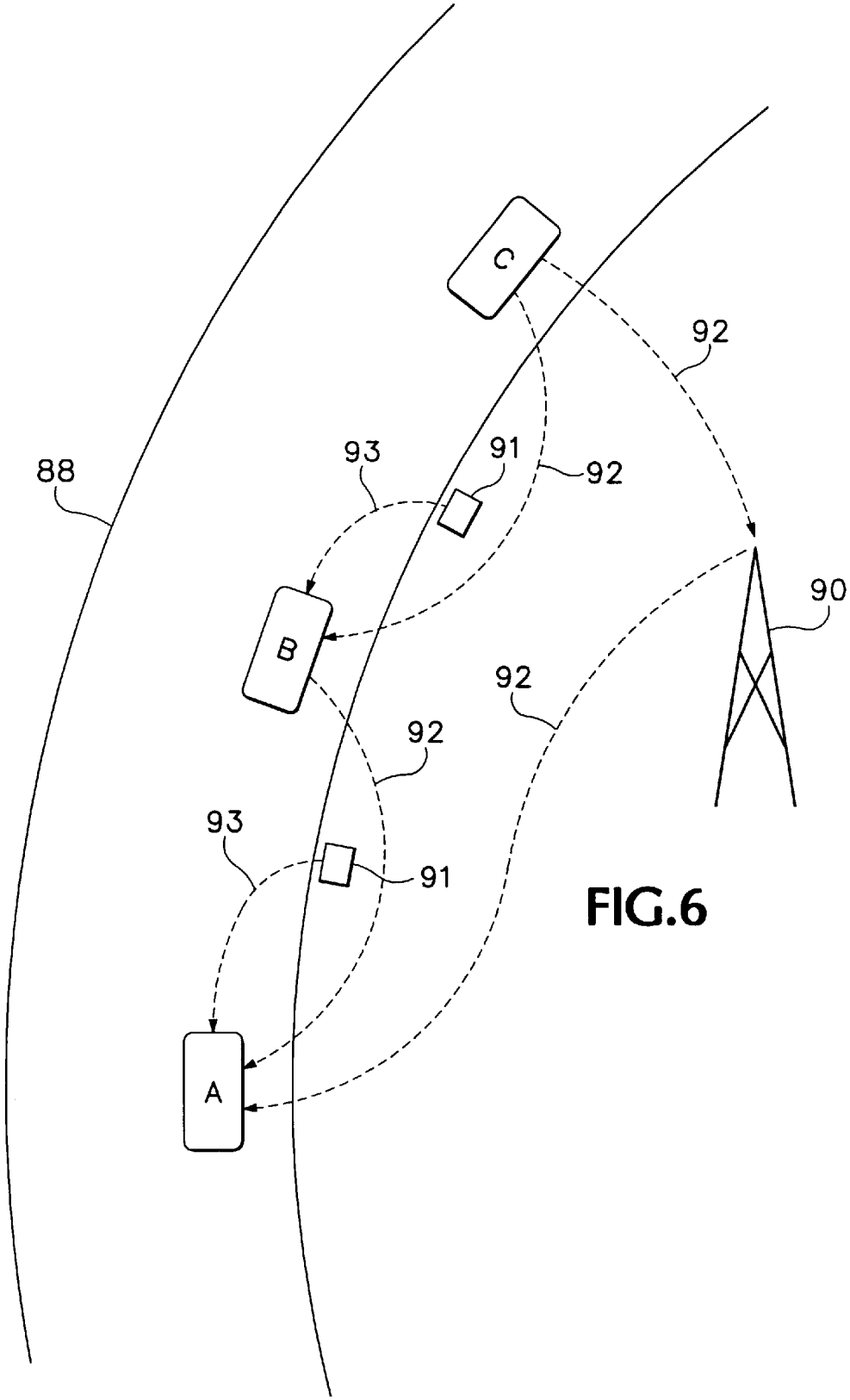
FIGS. 6 and 7 are diagrams showing how kinetic state information for multiple vehicles can be used to identify road direction.
Figure 7:
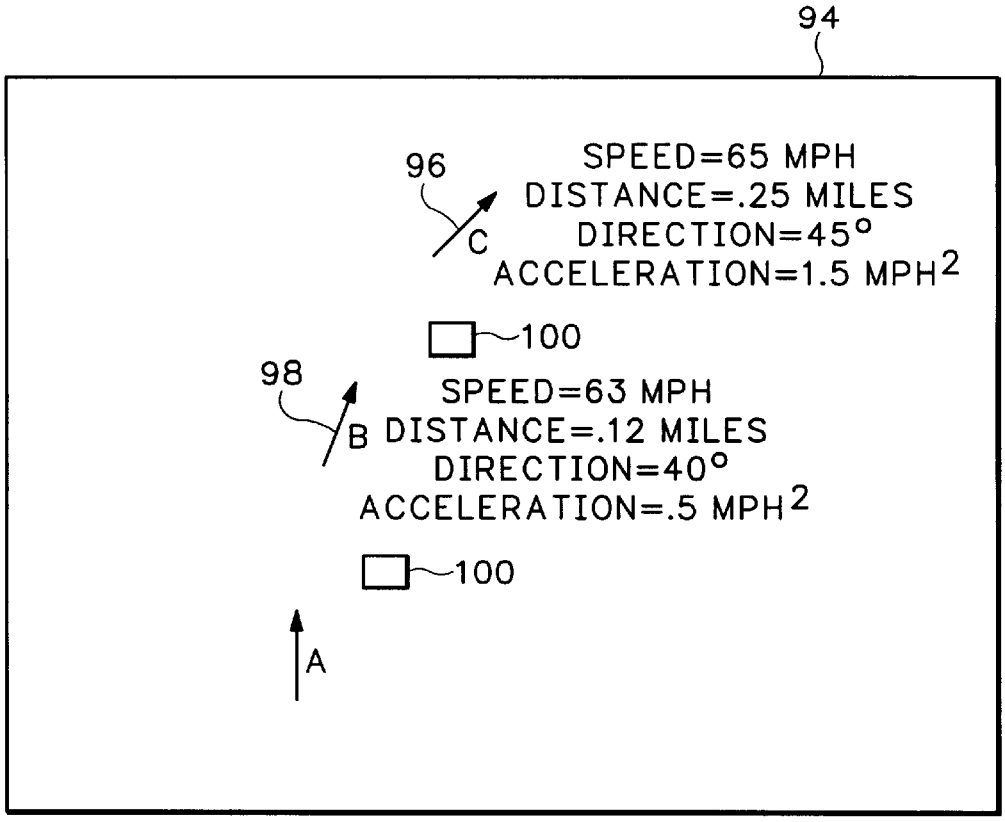

FIGS. 6 and 7 show an example of how the inter-vehicle communication system can be utilized to identify road direction. FIG. 6 shows three vehicles A, B, and C traveling along the same stretch of highway 88. Each vehicle includes a Global Positioning System (GPS) that periodically identifies a current longitude and latitude. Each vehicle A, B, and C generates kinematic state data 92 that includes position, velocity, acceleration or deceleration, and/or direction.

The kinematic state data 92 for each vehicle A, B, and C is broadcast to the other vehicles in the same vicinity. The vehicles A, B, and C receive the kinematic state data from the other vehicles and display the information to the vehicle driver. For example, in FIG. 7 shows a GUI 94 in vehicle A (FIG. 6). The GUI 94 shows any combination of the position, driving direction, speed, distance, and acceleration for the other vehicles B and C. Vectors 96 and 98 can visually represent this kinematic state data.

For example, the position of vector 98 represents the longitude and latitude of vehicle B and the direction of vector 98 represents the direction that vehicle B is traveling. The length of vector 98 represents the current speed and acceleration of vehicle 98. Displaying the kinematic state of other vehicles B and C allows the driver of vehicle A to anticipate curves and other turns in highway 88 (FIG. 6) regardless of the weather conditions.

Referring back to FIG. 6, the kinematic state data 92 for the vehicles A, B and C does not have to always be relayed by other vehicles. For example, the kinematic state data 92 can be relayed by a repeater located on a stationary tower 90. This may be desirable for roads with little traffic where there are generally long distances between vehicles on the same highway 88. There also may be transmitters 91 located on the sides of highway 88 that transmit location data 93. The transmitters may be located intermittently along different stretches of highway 88 to provide location references and to also identify dangerous curves in certain stretches of the highway 88.

The transmitters 91 may also send along with the location data 93 some indication that the data is being transmitted from a stationary reference post. The transmitters 91 can also include temperature sensors that detect different road conditions, such as ice. An ice warning is then generated along with the location data. The processors in the vehicles A, B and C then display the transmitters 91 as nonmoving objects 100 along with any road condition information in the GUI 94.

Figure 8:
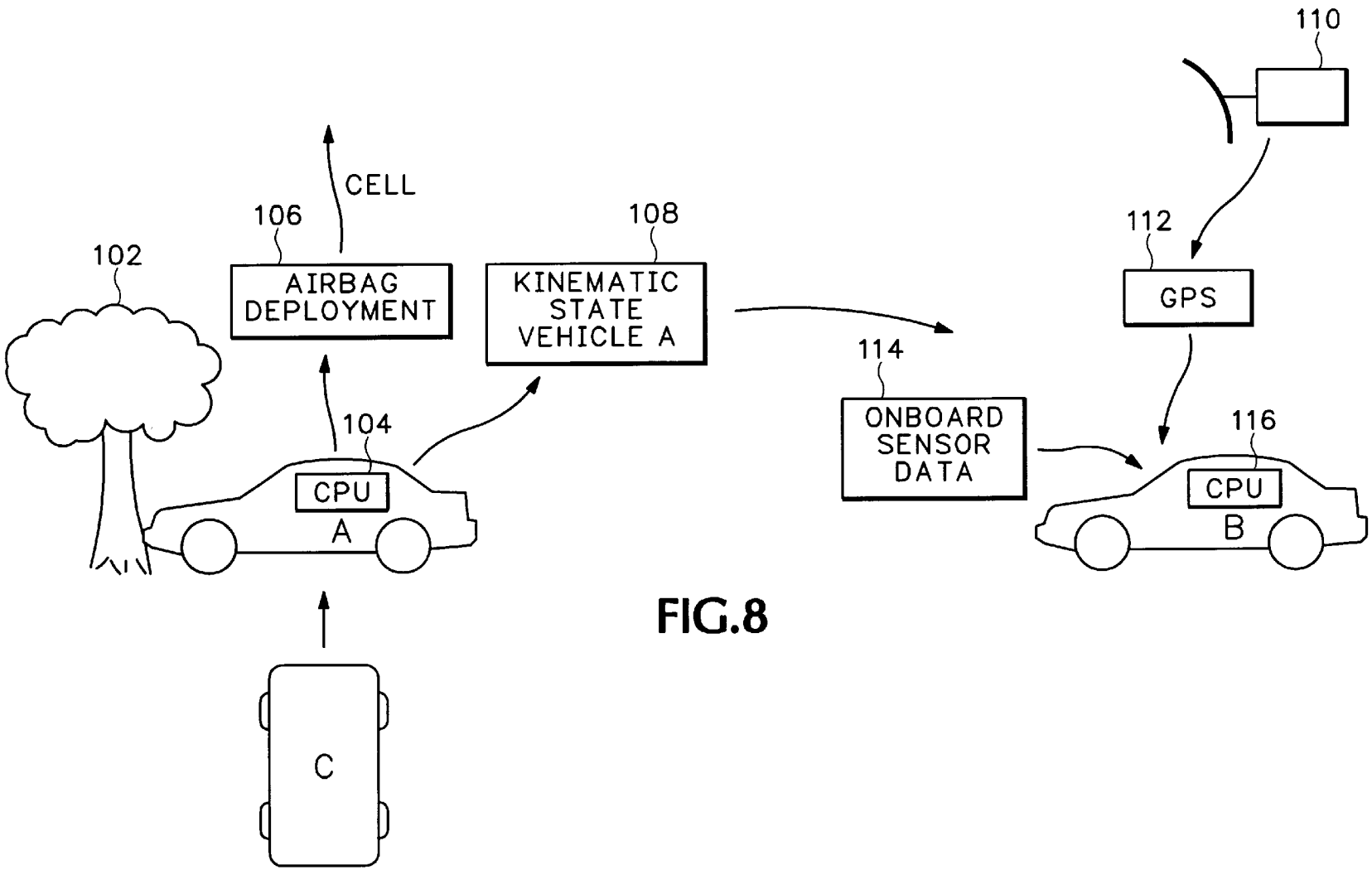
FIGS. 8 and 9 are diagrams showing how the inter-vehicle communication system is used to help avoid collisions.
Figure 9:
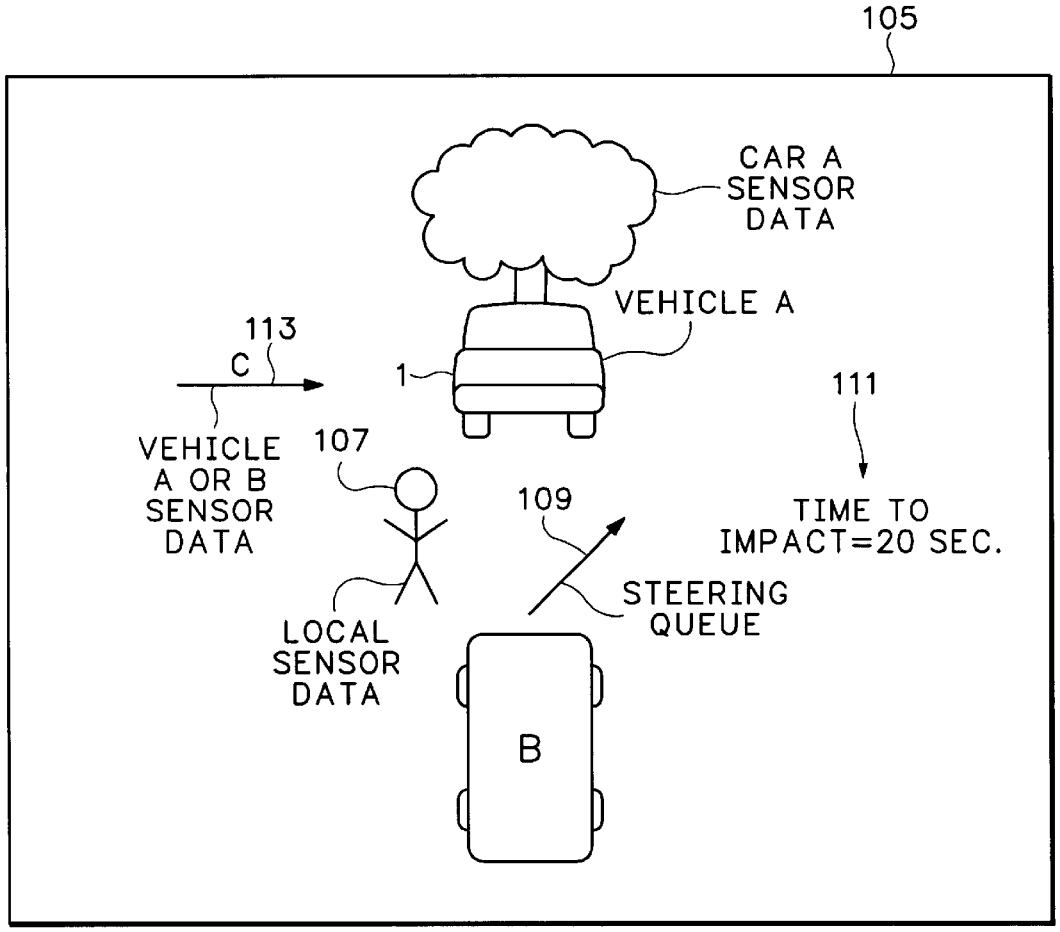

FIGS. 8 and 9 show in more detail how collision information is exchanged and used by different vehicles. In FIG. 8, vehicle A has collided with a tree 102. Upon impact with tree 102, the vehicle A deploys one or more airbags. A processor 104 in vehicle A detects the airbag deployment and automatically sends out an air bag deployment message 106 over a cellular telephone network to an emergency vehicle service such as AAA. At the same time, the processor 104 broadcasts the kinematic state data 108 of vehicle A. The kinematic state data 108 indicates a rapid deceleration of vehicle A. Along with the kinematic state data 108 the processor 104 may send a warning indication.

Another vehicle B receives GPS location data 112 from one or more GPS satellites 110. Onboard sensor data 114 is also monitored by processor 116 to determine the speed, direction, etc. of vehicle B. The onboard sensor data 114 may also include data from one or more sensors that are detecting objects within the vicinity of vehicle B.

The processor 116 in vehicle B determines a current location of vehicle B based on the GPS data 112 and the onboard sensor data 114. The processor 116 then determines if a danger condition exists by comparing the kinematic state of vehicle A with the kinematic state of vehicle B. For example, if vehicle A is within 50 feet of vehicle B, and vehicle B is traveling at 60 MPH, then processor 116 may determine that vehicle B is in danger of colliding with vehicle A. In this situation, a warning signal may be generated by processor 116. Alternatively, if vehicle A is 100 feet in front of vehicle B, and vehicle B is only traveling at 5 MPH, processor 116 may determine that no danger condition currently exists for vehicle B and no warning signal is generated.

FIG. 9 shows one example of how a GUI 105 in vehicle B displays information received from vehicle A and from local sensors. The processor 116 displays vehicle A directly in front of vehicle B. Either from sensor data transmitted from vehicle A or from local sensors, the processor 116 generates a motion vector 113 that identifies another vehicle C approaching from the left. The local sensors in vehicle B also detect another object 107 off to the left of vehicle B.

The processor 116 receives all of this sensor data information and generates a steering queue 109 that determines the best path for avoiding vehicle A, vehicle C and object 107. In this example, it is determined that vehicle B should move in a northeasterly direction to avoid colliding with all of the detected objects. The processor 116 can also calculate a time to impact 111 with the closest detected object by comparing the kinematic state of the vehicle B with the kinematic states of the detected objects.

Figure 10:
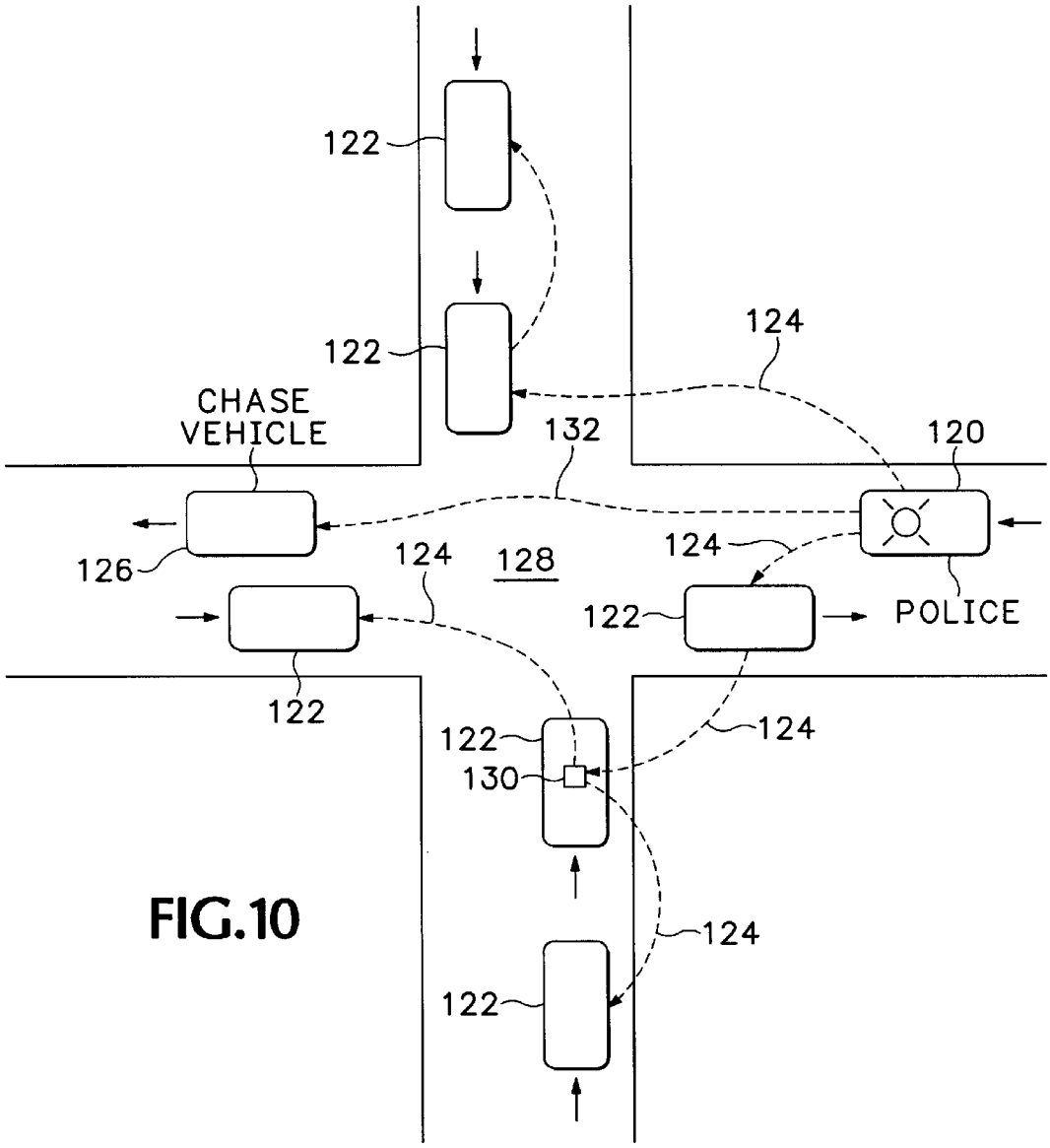
FIG. 10 is a diagram showing how an emergency signal is broadcast to multiple vehicles from a police vehicle.

FIG. 10 shows another example of how vehicle information may be exchanged between different vehicles. In this example, a police vehicle 120 is in pursuit of a chase vehicle 126. Police vehicle 120 may be entering an intersection 128. In order to avoid colliding with other vehicles that may be entering intersection 128, the police vehicle 120 broadcasts an emergency warning signal 124. The emergency warning signal 124 notifies all of the vehicles 122 that an emergency vehicle 120 is nearby and that the vehicles 122 should slowdown or stop.

Processors 130 in the vehicles 122 can generate an audible signal to the vehicle operator, display a warning icon on a GUI, and/or show the location of police vehicle 120 on the GUI. In another implementation, the processor 130 in each vehicle 122 receives the kinematic state of police vehicle 120 and determines a relative position of the local vehicle 122 in relation to the police vehicle 120. If the police vehicle 120 is within a particular range, the processor 130 generates a warning signal and may also automatically slow or stop the vehicle 122.

In another implementation, the police vehicle 120 sends a disable signal 132 to a processor (not shown) in the chase vehicle 126. The disable signal 132 causes the processor in chase vehicle 126 to automatically slow down the chase vehicle 126 and then eventually stop the chase vehicle 126.

Figure 11:
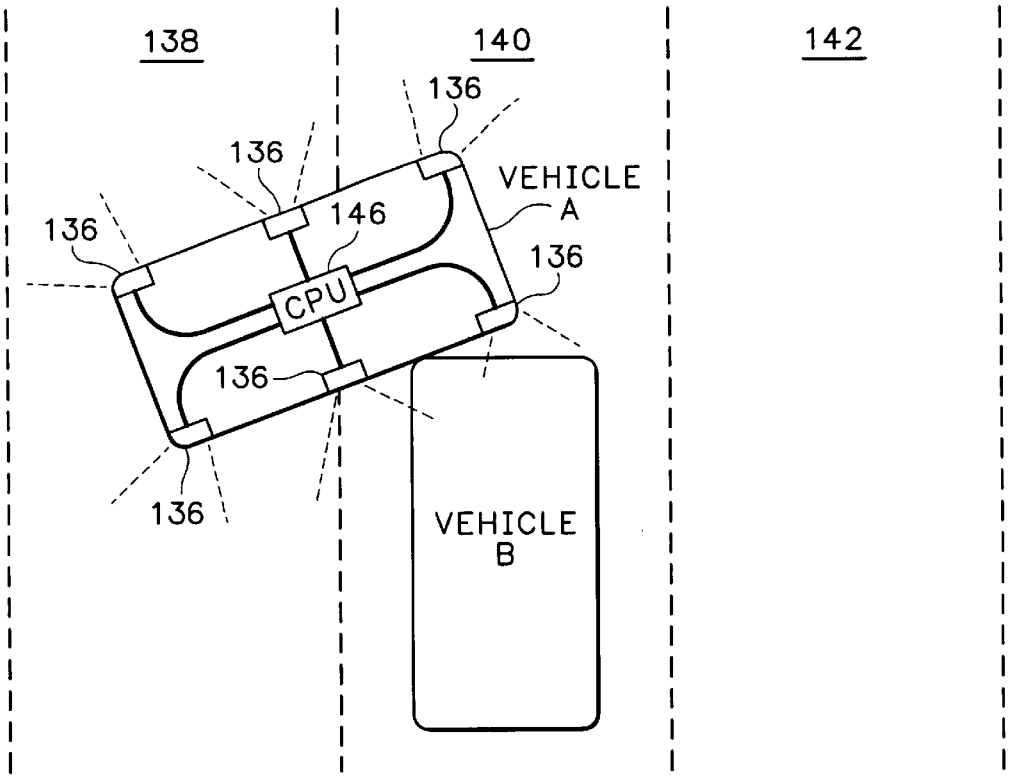
FIGS. 11 and 12 are diagrams showing sensors are used to indicate proximity of a local vehicle to other objects.
Figure 12:
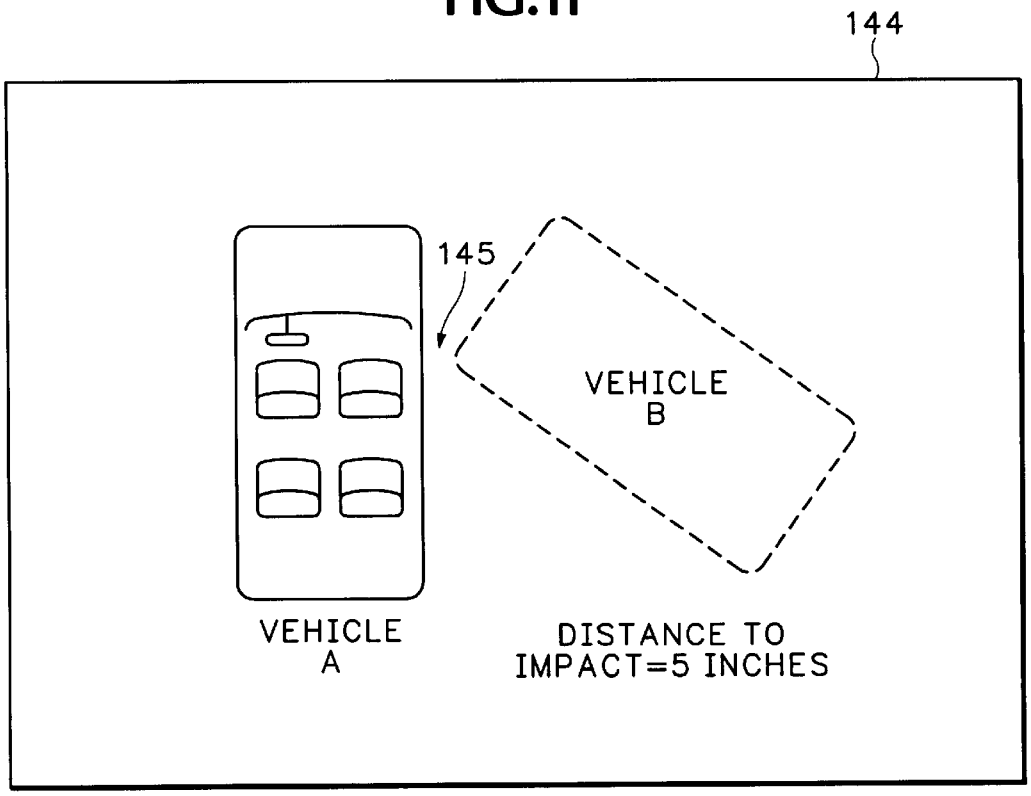

FIGS. 11 and 12 show another application for the sensors 136 that are located around vehicle A. Vehicles A and B are parked in parking slots 138 and 140, respectively. Vehicle A has pulled out of parking slot 138 and is attempting to negotiate around vehicle B. The operator of vehicle A cannot see how far vehicle A is from vehicle B.

The sensors 136 detect objects that come within a certain distance of vehicle A. These sensors 136 may be activated only when the vehicle A is traveling below a certain speed, or may be activated at any speed, or may be manually activated by the vehicle operator. In any case, the sensors 136 detect vehicle B and display vehicle B on a GUI 144 shown in FIG. 12. The processor in vehicle A may also determine the closest distance between vehicle A and vehicle B and also identify the distance to impact and the particular area of impact 145 on vehicle A.

As vehicle A moves within some specified distance of vehicle B, the processor 146 may generate a warning signal that is either annunciated or displayed to the vehicle operator on the GUI 144. This sensor system allows the vehicle operator to avoid a slow speed collision caused by the vehicle operator not being able to see the sides of the vehicle A. In another example, sensors on vehicle B (not shown) may generate a warning signal to processor 146 when vehicle A moves too close to vehicle B.

Figure 13:
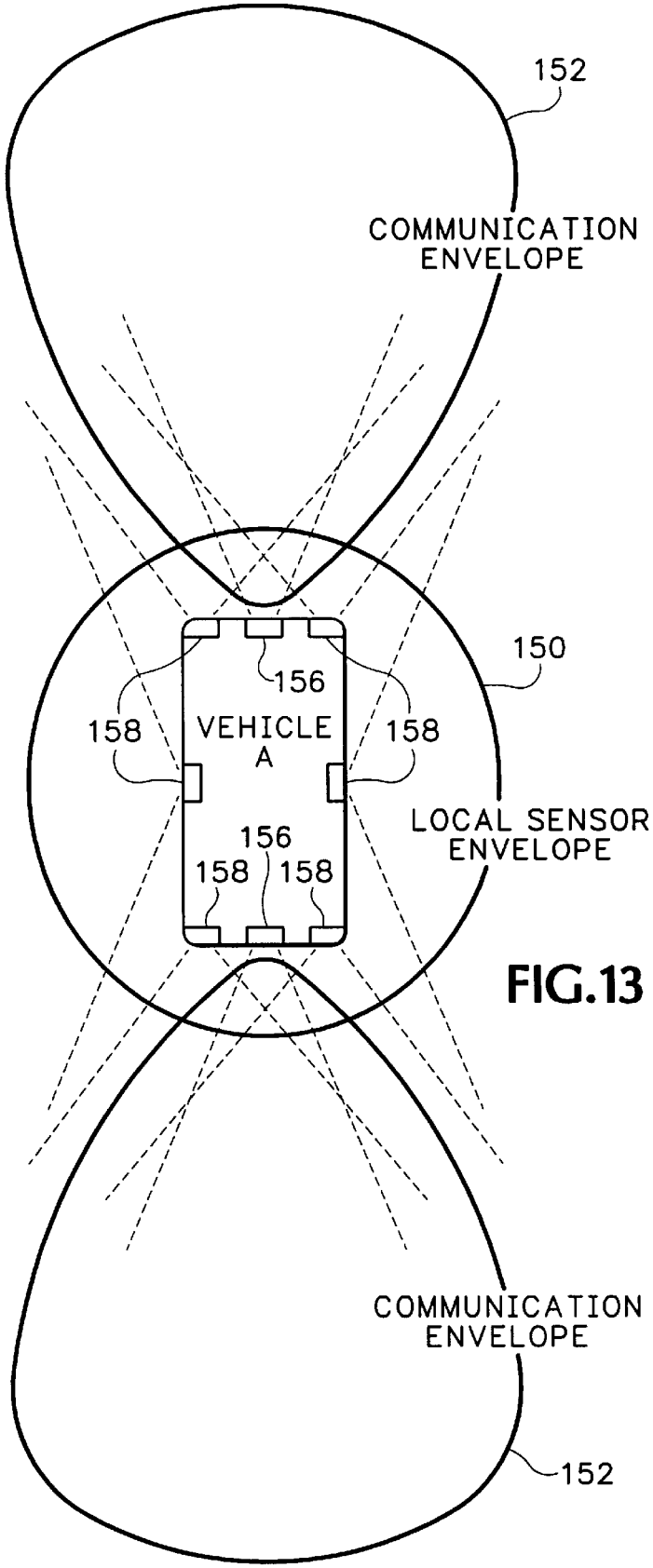
FIGS. 13 and 14 show different sensor and communication envelopes that are used by the inter-vehicle communication system.

FIG. 13 shows an example of sensor and communication envelopes that are generated by sensors and transceivers in vehicle A. A first local sensor envelope 150 is created around the vehicle A by multiple local sensors 158. The sensor data from the local sensor envelope 150 is used by a processor to detect objects located anywhere around vehicle A. Transceivers 156 are used to generate communication envelopes 152. The transceivers 156 allow communications between vehicles that are located generally in front and in back of vehicle A However, it should be understood that any variety of communication and sensor envelopes can be generated by transceivers and sensors in vehicle A.

Figure 14:
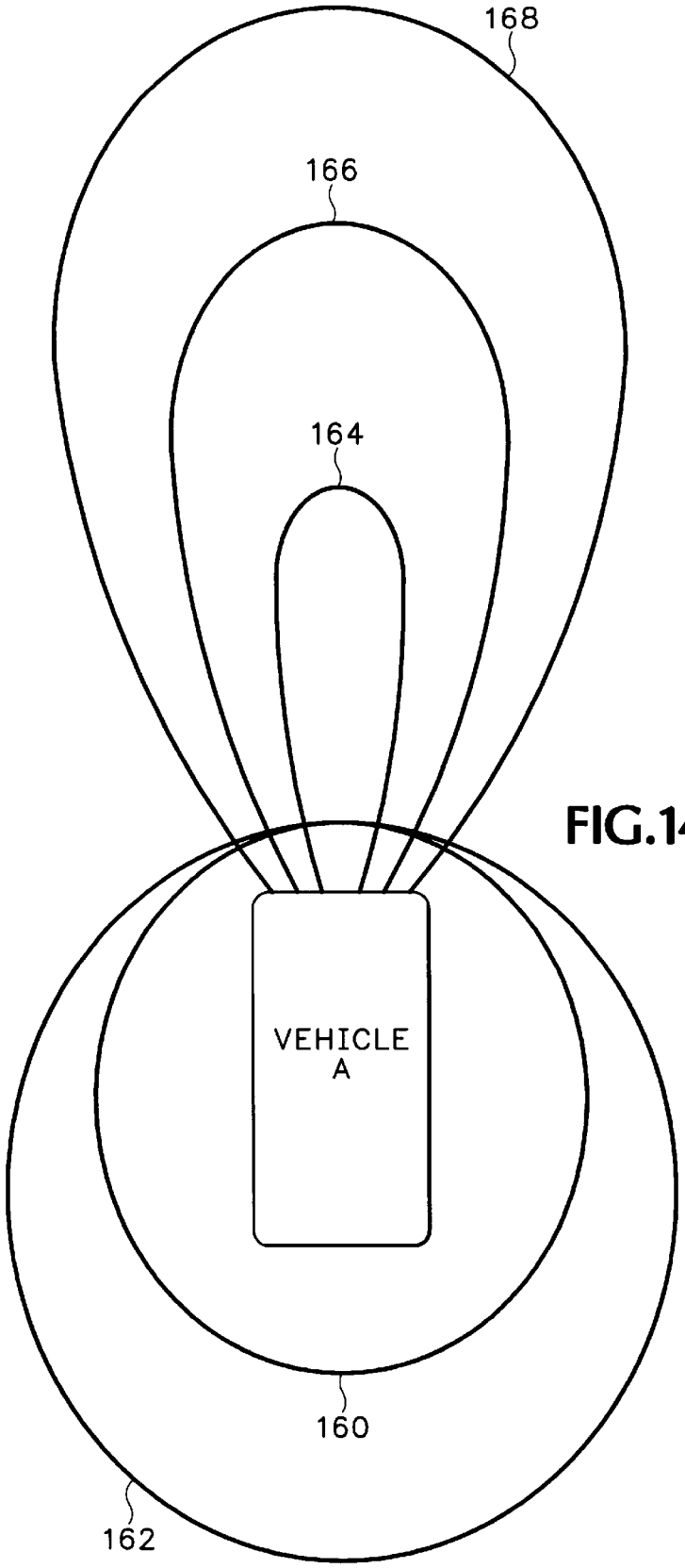

FIG. 14 shows another example of different sensor envelopes that can be generated around vehicle A. A first type of sensor, such as an infrared sensor, may be located around vehicle A to generate close proximity sensor envelopes 160 and 162. A second type of sensor and antenna configuration, such as radar antennas, may be used to generate larger sensor envelopes 164, 166, and 168.

The local sensor envelopes 160 and 162 may be used to detect objects in close proximity to vehicle A. For example, parked cars, pedestrians, etc. The larger radar envelopes 164, 166 and 168 may be used for detecting objects that are further away from vehicle A. For example, envelopes 164, 166, and 168 may be used for detecting other vehicles that are longer distances from vehicle A.

The different sensor envelopes may dynamically change according to how fast the vehicle A is moving. For example, envelope 164 may be used when vehicle A is moving at a relatively low speed. When vehicle A accelerates to a higher speed, object detection will be needed for longer distances. Thus, the sensors may dynamically change to larger sensor envelopes 166 and 168 when vehicle A is moving at higher speeds. Any combination of local sensor envelopes 160 and 162 and larger envelopes 164, 166, and 168 may be used.

Figure 15:
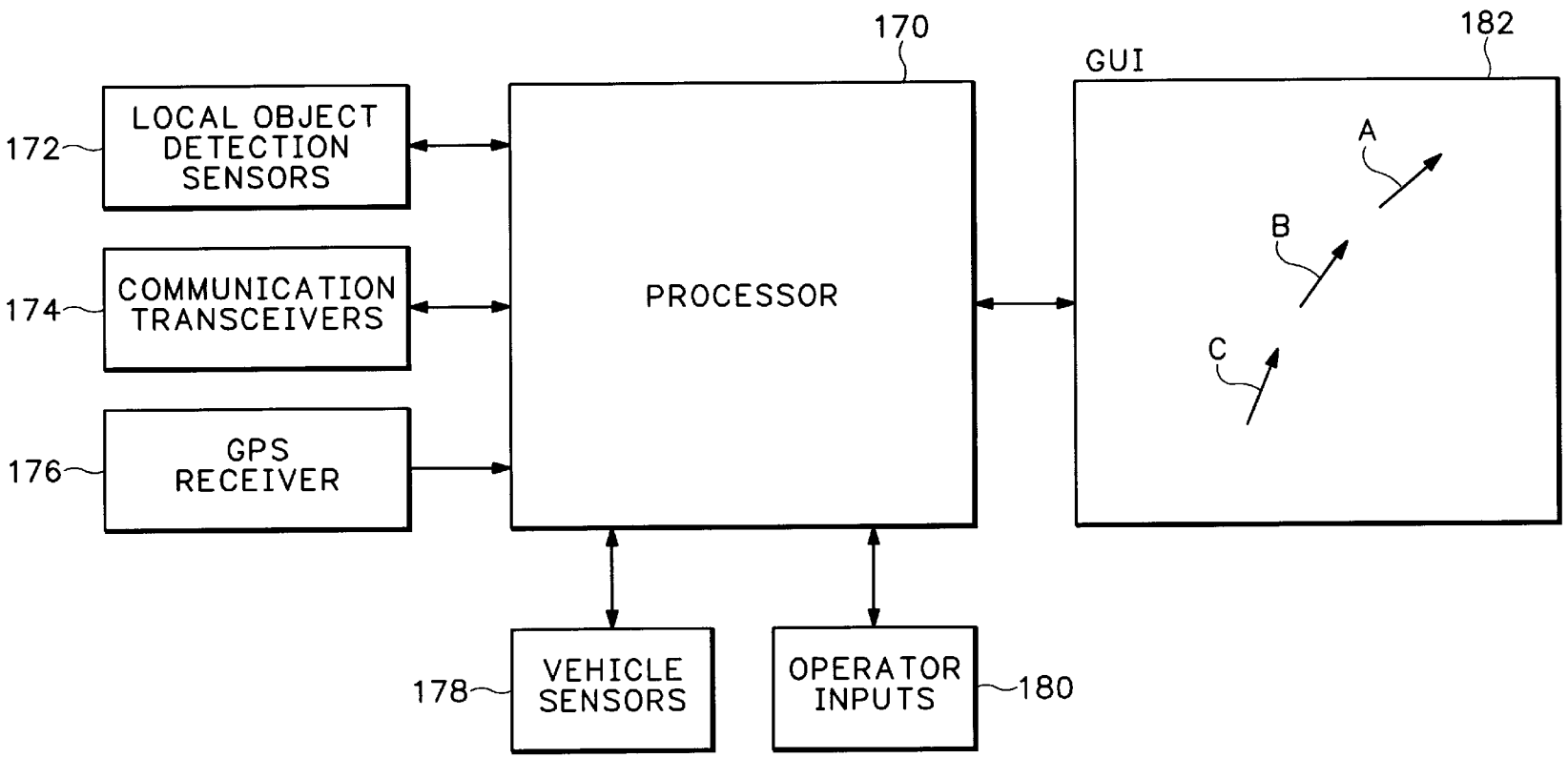
FIG. 15 is a block diagram showing the different data inputs and outputs that are coupled to an inter-vehicle communication processor.

FIG. 15 is a detailed diagram of the components in one of the vehicles used for gathering local sensor data and receiving external sensor data from other vehicles. A processor 170 receives sensor data from one or more local object detection sensors 172. The sensors may be infrared sensors, radar sensors, or any other type of sensing device that can detect objects. Communication transceivers 174 exchange sensor data, kinematic state data, and other notification messages with other vehicles. Any wireless communication device can be used for communicating information between the different vehicles including microwave, cellular, Citizen Band, two-way radio, etc.

A GPS receiver 176 periodically reads location data from GPS satellites. Vehicle sensors 178 include any of the sensors or monitoring devices in the vehicle that detect vehicle direction, speed, temperature, collision conditions, breaking state, airbag deployment, etc. Operator inputs 180 include any monitoring or selection parameter that may be input by the vehicle operator. For example, the operator may wish to view all objects within a 100 foot radius. In another situation, the operator may wish to view all objects within a one mile radius. The processor display the objects within the range selected by the operator on GUI 182.

In another situation, the speed of the vehicle identified by vehicle sensors 178 may determine what data from sensors 172 or from transceivers 174 is used to display on the GUI 182. For example, at higher speeds, the processor may want to display objects that are further distances from the local vehicle.

Figure 16:
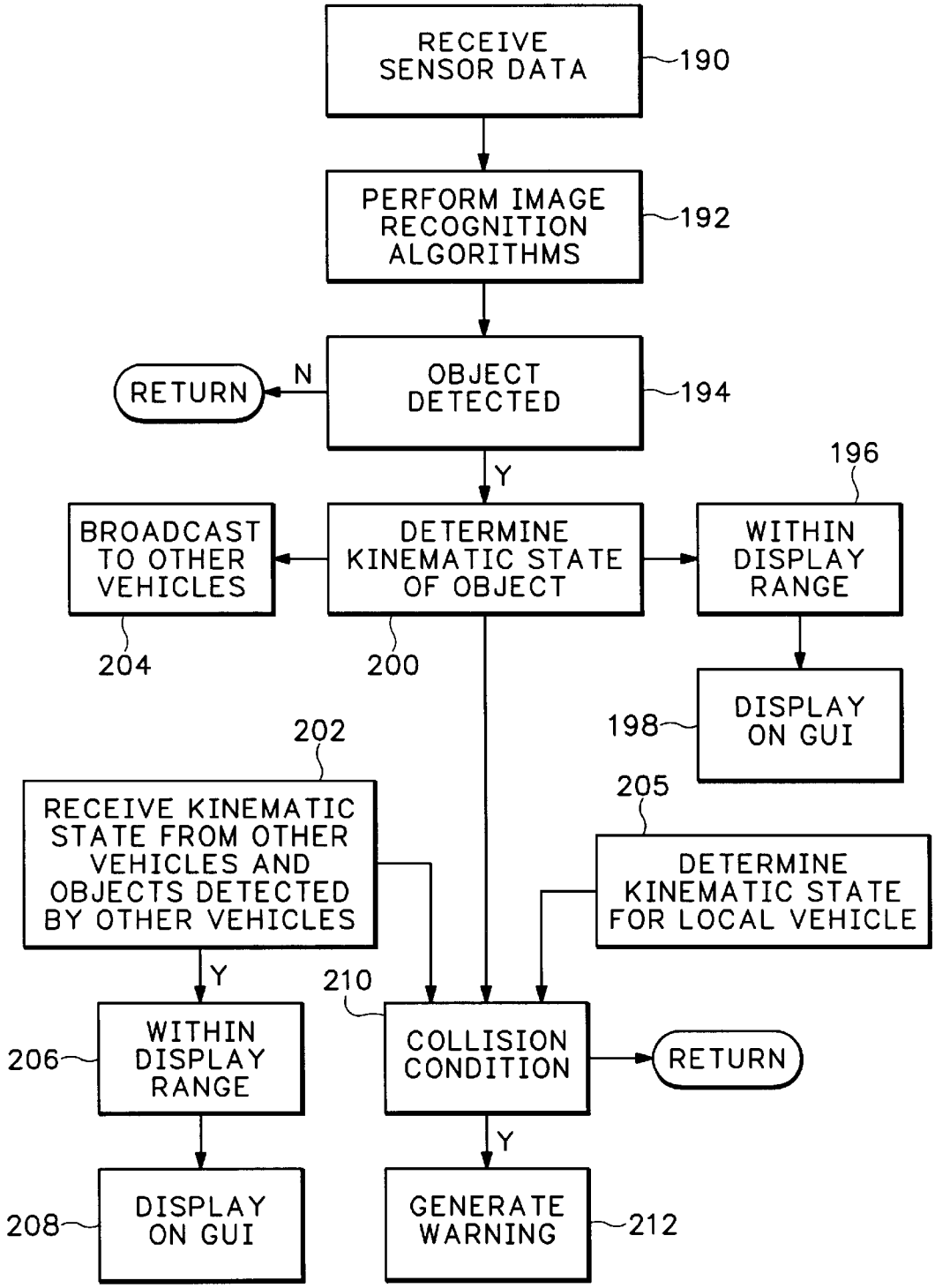
FIG. 16 is a block diagram showing how the processor in FIG. 15 operates.

FIG. 16 is a block diagram showing how the processor in one of the vehicles operates. In block 190, the processor receives sensor data from sensors on the local vehicle. The processor performs image recognition algorithms on the sensor data in block 192. If an object is detected in block 194, kinematic state data for the object is determined in block 200.

If the detected object is within a specified range in block 196, then the object is displayed on the GUI in block 198. For example, the current display range for the vehicle may only be for objects detected within 200 feet. If the detected object is outside of 200 feet, it will no be displayed on the GUI.

At the same time, the processor receives kinematic state data for other vehicles and objects detection data from the other vehicles in block 202. Voice data from the other vehicles can also be transmitted along with the kinematic state data. In a similar manner as blocks 196 and 198, if any object detected by another vehicle is within a current display range in block 206, then the other object is displayed on the GUI in block 208. At the same time, the processor determines the current kinematic state its own local vehicle in block 205.

The processor in block 210 compares the kinematic state information of the local vehicle with all of the other objects and vehicles that are detected. If a collision condition is eminent based on the comparison, then the processor generates a collision warning in block 212. A collision condition is determined in one example by comparing the current kinematic state of the local vehicle with the kinematic state of the detected objects. If the velocity vector (current speed and direction) of the local vehicle is about to interest with the velocity vector for another detected object, then a collision condition is indicated and a warning signal generated.

Collision conditions are determined by analyzing the bearing rate of change of the detected object with respect to the local vehicle. For example, if the bearing rate of change continues to change, it is not likely that a collision condition will occur and no warning signal is generated. However, if the bearing rate of change remains constant for the detected object with respect to the local vehicle, the processor identifies a possible collision condition. When the range and speed between the detected object and the local vehicle are within a first probably of avoidance range, a first warning signal is generated. At a second probably of impact range, a second collision signal is generated.

The system described above can use dedicated processor systems, micro controllers, programmable logic devices, or microprocessors that perform some or all of the operations. Some of the operations described above may be implemented in software and other operations may be implemented in hardware.

For the sake of convenience, the operations are described as various interconnected functional blocks or distinct software modules. This is not necessary, however, and there may be cases where these functional blocks or modules are equivalently aggregated into a single logic device, program or operation with unclear boundaries. In any event, the functional blocks and software modules or described features can be implemented by themselves, or in combination with other operations in either hardware or software.

Having described and illustrated the principles of the invention in a preferred embodiment thereof, it should be apparent that the invention may be modified in arrangement and detail without departing from such principles. Claim is made to all modifications and variation coming within the spirit and scope of the following claims.

What is claimed is:

1. An inter-vehicle communication system, comprising:

a local sensor in a local vehicle for gathering sensor data around the local vehicle;

a transmitter in the local vehicle for transmitting the gathered sensor data;

a receiver in the local vehicle for receiving sensor data from other vehicles; and a processor for displaying the sensor data gathered from both the local sensor and from the other vehicles, the processor providing kinematic state data for both the local vehicle and for objects detected in the sensor data for transmission to other vehicles.

2. An inter-vehicle communication system according to claim 1 wherein the processor detects different objects in the sensor data.

3. An inter-vehicle communication system according to claim 2 wherein the processor generates a warning signal according to how close the detected objects are from the local vehicle.

4. An inter-vehicle communication system according to claim 3 wherein the processor identifies kinematic states for objects detected in the sensor data.

5. An inter-vehicle communication system according to claim 4 including a GPS receiver that receives location data for the local vehicle, the processor using the location data to determine a kinematic state for the local vehicle.

6. An inter-vehicle communication system according to claim 5 wherein the processor compares the kinematic state of the local vehicle with the kinematic states of the detected objects and generates a collision warning signal according to the comparison.

7. An inter-vehicle communication system according to claim 1 wherein the kinematic state data includes both a direction and speed of both the local vehicle and any objects identified in the sensor data.

8. An inter-vehicle communication system according to claim 1 wherein the receiver receives sensor information from a first vehicle and then relays that sensor information to a second vehicle.

9. An inter-vehicle communication system according to claim 1 wherein the processor broadcasts an emergency notification signal to the other vehicles.

10. An inter-vehicle communication system according to claim 1 including multiple sensors for sensing objects both on the sides and in front of the local vehicle.

11. An inter-vehicle communication system according to claim 10 including infrared sensors for generating sensor information around a local perimeter of the local vehicle and a radar sensor for generating sensor data outside of the local perimeter.

12. An inter-vehicle communication system comprising:

a local sensor in a local vehicle for gathering sensor data around the local vehicle;

a transmitter in the local vehicle for transmitting the gathered sensor data;

a receiver in the local vehicle for receiving sensor data from other vehicles;

a processor for displaying the sensor data gathered from both the local sensor and from the other vehicles; and wherein the processor detects different objects in the sensor data and generates a steering queue showing what direction the local vehicle should travel to avoid the detected objects.

13. An inter-vehicle communication system comprising:

a local sensor in a local vehicle for gathering sensor data around the local vehicle;

a transmitter in the local vehicle for transmitting the gathered sensor data;

a receiver in the local vehicle for receiving sensor data from other vehicles; and a processor for displaying the sensor data gathered from both the local sensor and from the other vehicles wherein the processor provides an emergency notification signal to be broadcast to be broadcast to the other vehicles and the emergency notification signal includes an airbag deployment indication.

14. A method for detecting objects, comprising:

generating sensor data for areas around a local vehicle;

identifying and object in the sensor data;

determining a kinematic state for the object identified in the sensor data;

determining a kinematic state for the local vehicle;

comparing the kinematic state of the object with the kinematic state of the local vehicle;

generating a warping indication when the comparison indicates a possible collision condition exists between the identified object and the local vehicle; and transmitting the kinematic state for the object identified in the sensor data to other vehicles.

15. A method according to claim 14 including generating sensor data in front, in back and on sides of the vehicle and identifying any objects that may be approaching the local vehicle from the front, back, or the sides.

16. A method according to claim 14 including displaying identified objects that come within a preselected perimeter of the local vehicle.

17. A method according to claim 16 including identifying a distance to impact between the identified objects and the local vehicle.

18. A method according to claim 16 including identifying where the identified objects are located in relationship to the local vehicle.

19. A method according to claim 14 including receiving the kinematic state of another vehicle and displaying the kinematic state of the local vehicle in relation to the other vehicle.

20. A method according to claim 14 including automatically transmitting a warning signal to other vehicles when an emergency condition occurs.

21. A method according to claim 20 the emergency condition comprises activation of a collision air bag.

22. A method according to claim 14 including:

receiving road condition data and an identifier identifying where the road condition is located; and displaying the location of the road condition on an electronic map.

23. A method according to claim 22 including transmitting the road condition data from the location where the road condition is located.

24. A method according to claim 23 including locating road condition transmitters along sides of the road that identify a geographical location and detect icy road conditions and transmitting geographical location and the icy road conditions in the road condition data.

25. A method according to claim 14 including identifying a distance to impact of the local vehicle with the detected object.

26. A method for detecting objects, comprising:

generating sensor data for areas around a local vehicle;

identifying an object in the sensor data;

determining a kinematic state for the object identified in the sensor data;

determining a kinematic state for the local vehicle;

comparing the kinematic state of the object with the kinematic state of the local vehicle;

generating a warning indication when the comparison indicates a possible collision condition exists between the identified object and the local vehicle;

generating sensing data in an area around a first vehicle;

detecting an object in the sensing data;

determining kinematic state for the detected object;

determining kinematic state for the first vehicle;

transmitting the kinematic state for the first vehicle and the object to an intermediary vehicle;

determining kinematic state for the intermediary vehicle;

transmitting the kinematic state for the object, the first vehicle and the intermediary vehicle from the intermediary vehicle to the local vehicle; and displaying the kinematic state for the object, the first vehicle and the intermediary vehicle in relation to the kinematic state of the local vehicle.

27. A method for detecting objects, comprising:

generating sensor data for areas around a local vehicle;

identifying an object in the sensor data;

determining a kinematic state for the object identified in the sensor data;

determining a kinematic state for the local vehicle;

comparing the kinematic state of the object with the kinematic state of the local vehicle;

generating a warning indication when the comparison indicates a possible collision condition exists between the identified object and the local vehicle; and receiving an emergency signal from a first vehicle that includes a kinematic state of the first vehicle and a danger indication signal and displaying the kinematic state and danger indication signal in the local vehicle.

28. A method according to claim 27 including automatically slowing down or stopping the local vehicle according to the emergency signal.

29. A method for detecting objects, comprising:

generating sensor data for areas around a local vehicle;

identifying an object in the sensor data;

determining a kinematic state for the object identified in the sensor data;

determining a kinematic state for the local vehicle;

comparing the kinematic state of the object with the kinematic state of the local vehicle;

generating a warning indication when the comparison indicates a possible collision condition exists between the identified object and the local vehicle; and generating a steering queue that provides a direction for the local vehicle to move to avoid the identified object.

* * * * *